US006881717B1

(12) United States Patent
Hall et al.

(10) Patent No.: US 6,881,717 B1
(45) Date of Patent: Apr. 19, 2005

(54) FABRIC SOFTENING COMPONENT

(75) Inventors: Robin Gibson Hall, Newcastle upon Tyne (GB); Nathalie Sophie Letzelter, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/936,403

(22) PCT Filed: Mar. 30, 2000

(86) PCT No.: PCT/US00/08517

§ 371 (c)(1),
(2), (4) Date: Sep. 11, 2001

(87) PCT Pub. No.: WO00/60039

PCT Pub. Date: Oct. 12, 2000

(30) Foreign Application Priority Data

Apr. 1, 1999 (GB) ..... 9907593

(51) Int. Cl.[7] ..... C11D 7/16
(52) U.S. Cl. ..... 510/517
(58) Field of Search ..... 510/515, 516, 510/517, 518

(56) References Cited

U.S. PATENT DOCUMENTS

| | | | | |
|---|---|---|---|---|
| 4,230,590 | A | | 10/1980 | Wixon |
| 4,526,702 | A | | 7/1985 | Parr et al. |
| 4,699,729 | A | | 10/1987 | Parr et al. |
| 4,758,378 | A | * | 7/1988 | Raemdonck et al. ..... 252/544 |
| 4,844,821 | A | * | 7/1989 | Mermelstein et al. ..... 252/8.7 |
| 4,885,101 | A | | 12/1989 | Tai |
| 5,062,972 | A | * | 11/1991 | Baeck et al. ..... 252/8.8 |
| 5,209,857 | A | | 5/1993 | Kenyon et al. |
| 5,234,640 | A | | 8/1993 | Amano et al. |
| 5,364,553 | A | * | 11/1994 | Cao ..... 252/174.12 |
| 5,604,197 | A | * | 2/1997 | Busch et al. ..... 510/516 |
| 5,668,073 | A | | 9/1997 | Convents et al. |
| 5,759,982 | A | * | 6/1998 | Wise et al. ..... 510/352 |
| 6,520,209 | B1 | | 2/2003 | Lundqvist |
| 6,620,209 | B1 | | 9/2003 | Kischkel et al. |
| 6,689,739 | B1 | | 2/2004 | Hall |

FOREIGN PATENT DOCUMENTS

| | | |
|---|---|---|
| EP | 0 299 575 A1 | 1/1989 |
| EP | 0 313 146 A2 | 4/1989 |
| EP | 387 426 B1 | 9/1990 |
| EP | 710 713 A2 | 5/1996 |
| GB | 2 297 977 A | 8/1996 |
| WO | WO 95/27037 | 10/1995 |
| WO | WO 97/09406 | 3/1997 |

* cited by examiner

*Primary Examiner*—John R. Hardee
(74) *Attorney, Agent, or Firm*—Julia A. Glazer; Brahm J. Corstanje; Kim William Zerby

(57) ABSTRACT

The present invention relates to fabric softening component comprising a clay, a flocculating agent, a surfactant and a carrier material. The carrier material is preferably a powdered or granular builder or alkalinity source. The component is preferably a spray-dried particle, extrudate or an agglomerate. It preferably comprises at least a sulphate and/or sulphonate surfactant, a zeolite and/or phosphate builder and a carbonate salt. Highly preferred is that the component also comprises a brightener.

13 Claims, No Drawings

FABRIC SOFTENING COMPONENT

TECHNICAL FIELD

The present invention relates to a softening component for use as softener for fabrics, comprising a clay and a flocculating agent, a surfactant system and a carrier material. The component may also be used in detergent compositions.

BACKGROUND TO THE INVENTION

Clays have been used for several years in detergents to provide softening of the fabrics washed with the compositions. The have been described as materials which can be dry-added to the other detergent granules, or can be mixed with other ingredients. EP-A-313146 described clay particles 60% to 99% clay and a humectant, which are added to a detergent composition.

Clay flocculating agent have also been known for several years, to improve the deliver of the clay to the fabric. EP-A-313146 also describes that the detergents containing the clay particles comprise preferably a clay flocculating agent.

The inventors have now found that when the efficiency of the clay deposition can be enhanced when the clay and the flocculating agent are present in an intimate mixture with one another. Not only does this improve clay deposition efficiency but this also allows for the same softness performance to be delivered with reduced levels of clay.

Whilst deposition of the clay is enhanced by the use of the intimate mixtures, it has been found that it is also important to effectively distribute the flocculating clay during the wash. The inventors have found that this is achieved by mixing the mixture of clay and flocculating agent with a surfactant. However, the also found that the delivery is even further improved when also a powdered or granular carrier material is mixed with the clay, flocculating agent and surfactant. Furthermore, the use of the surfactant improves the ease of mixing of the clay and the flocculating agent whilst the carrier material allows the formation of a non-sticky and easy handable mixture, which can be processed easily in to its required form. In this form the mixture has also be found to more storage stable, which is advantages because the mixture can then be stored until final use and it does not to be further processed immediately.

It is highly preferred that the carrier material comprises an alkalinity source and/or a builder, because then a multi-purpose softening component is obtained. Such a component can be useful in several applications, including as component of a detergent composition, as a component of a fabric softener composition, or as washing and softening component on its own, in particular for hand washing or washing of small washing loads or of washing loads which are not to heavily soiled.

SUMMARY OF THE INVENTION

The invention relates to a solid fabric softening component comprising a) a clay;

b) at least 5% of a surfactant system;

c) at least 15% by weight of a solid carrier material;

d) a flocculating agent.

The component is preferably in the form of a spray-dried particle, agglomerate, or extrudate. The component may however also be processed a tablet form or bar form. The component can be used in any of these forms to treat fabrics, or it can be used as part of a detergent compositions or fabric softener composition. The component can be used in both automatic washing and hand washing, including also pre-treatment or soaking, or post-treatment such as fabric conditioning.

Softening Component

The component of the invention comprises at least a clay, a flocculating agent, a surfactant and a solid carrier material.

The total level of surfactant in the component is preferably form 5% to 90%, more preferably from 10% to 70% or even 60%, more preferably from 15% to 60% or even 50% by weight of the component.

Preferably the surfactant comprises at least an anionic sulphate surfactant or an anionic sulphonate surfactant. Preferred sulphonate and sulphate surfactants are described herein after.

The sulphonate or sulphate surfactant or mixtures thereof are preferably present at a level of from 5% to 60% by weight of the component, more preferably from 10% to 60% or even from 15% to 50% by weight of the component.

It may be preferred is that the component comprises a nonionic surfactant or mixtures thereof, either as only surfactant or combined with other surfactants. The nonionic surfactant are preferably present at a level of from 2% to 60% by weight of the component, more preferably from 5% to 50% or even from 10% to 45% by weight of the component The carrier material is preferably in granular or powdered form. The carrier material comprises preferably an alkalinity source and/or a builder Preferred alkalinity sources are inorganic carbonate salts. Preferred builders (which are often also alkaline) are aluminosilicates, crystalline silicates, amorphous silicates, crystalline layered silicates, phosphate salts, carboxylic acids or salts thereof. However, also other inorganic salts such a sulphate salts can be used. Preferred salts of the types mentioned above are sodium salts. It may be preferred that at least one potassium salt is present in the intimate mixture with the clay.

The carrier material is preferably present at a level of from 20% to 95% by weight, more preferably from 25% to 90% or even to 80% by weight, more preferably even form 30% to 70% by weight.

Hereby, it can be preferred that the inorganic carbonate salt is present at least 10% or even 15% by of the component, preferably up to levels of 60% or even 50% or even 40% by weight.

Highly preferred herein is the presence of at least a phosphate salt or aluminosilicate builder. Hereby, it can be preferred that the builder, preferably the phosphate and/or alumnisilicate builder is or are present at least 10% or even 15% by of the component, preferably up to levels of 60% or even 50% or even 40% by weight.

Whilst silicates are useful and even preferred herein, they are preferably used in addition to at least one other builder or alkalinity source.

The clay is preferably present at a level of at least 1%, more preferably at a level of from 2% to 60%, more preferably from 5% to 40% or even form 5% to 30% or even from 7% to 25% by weight of the component.

The component is prepared by mixing the clay, flocculating agent, carrier material and surfactant. Thus, the materials are intimately mixed with one another. This can be done my any mixing process or granulation process known in the art. However, the order of mixing can highly influence the final performance of the component. Preferred mixing processes are:

- in one embodiment, the clay and flocculating agent are in an intimate mixture with one another, obtained by mixing the clay and the flocculating agent, which is subsequently dispersed into or with the surfactant system, the carrier material or an intimate mixture of the surfactant and the carrier material.
- in another highly preferred embodiment the flocculating agent and surfactant system or part thereof, or the carrier material or part thereof, but preferably both the surfactant system and the carrier material or part thereof, are first intimately mixed and this mixture is subsequently mixed or dispersed with the clay. Optionally the remaining carrier material and/or surfactant is then subsequently mixed with the resulting mixture.
- in another preferred embodiment the clay is first intimately mixed with the carrier material or part thereof, whereafter this mixture is dispersed with or in, or mixed with the flocculating agent and the surfactant and optionally the remaining carrier material. Optionally, part of the surfactant can be mixed in the first step with the clay and the carrier material or part thereof.

The weight ratio of clay to the flocculating polymer is preferably from 1000:1 to 1:1, more preferably from 500:1 to 1:1, most preferably from 300:1 to 1:1, or even more preferably from 80:1 to 10:1, or in certain applications even from 60:1 to 20:1.

The weight ratio of the clay to the carrier material is preferably from 1:30 to 5:1, more preferably from 1:20 to 3:1, even more preferably from 1:15 to 1:1 or even from 1:10 to 1:2. The weight ratio of the surfactant to the clay is preferably from 1:30 to 10:1, more preferably from 1:15 to 5:1, even more preferably from 1:10 to 3:1 or even from 1:5 to 1:1.

Highly preferred is the presence of a brightener, not only to provide brighteness or whiteness of the fabrics, but also to improve the appearance of the component. The brightener is preferably present at a level of at least 0.05% by weight, more preferably at least 0.1% or even 0.15% or even 0.2% by weight of the component.

The component may also comprise free moisture, preferably not more than 30% by weight of the component, more preferably from 0.5% to 20% or even from 1% to 15% or even at least 5% by weight of the component. However, it may be preferred that water-sensitive ingredients are present, such as effervescence systems, enzymes, bleaches, perfumes, in which case it may be preferred that the free moisture level is less that the levels specified above, e.g. below 12% by weight, more preferably below 6% or even 5%, most preferably below 4% or even 3% by weight of the component.

In one preferred embodiment the component comprises an organic or inorganic acid, in particular when a carbonate salt is present, to provide effervescence with the carbonate salt. Preferred acids include citric acid, tartaric acid, lactic acid, maleic acid, malic acid, glutaric acid, adipic acid, acetic acid and aminoacids.

The component may also comprise other fabric care agent such as soil release polymers, cellulosic polymer, dye transfer inhibitors, cationic softeners, or mixtures thereof. Also present may be perfume components, which is highly preferred, but also enzymes or chelating agents.

The component is preferably a spray-dried particle or an agglomerated particle, or alternatively an extrudate or flake or it may be processed into the form of a tablet or bar. These particle can be made by known granulation, spray-drying, agglomeration, extrusion or tabletting methods, involving intimately mixing the ingredients, optionally adding water or other solvents and optionally drying.

Clay

The clay herein can be any clay, capable to provide softness to the fabric. For clarity, it is noted that the term clay, as used herein, excludes sodium aluminosilicate zeolite builder compounds, which however, may be included in the components of the invention as carrier material or part thereof.

It may be preferred that the component comprises a mixture of clays.

One preferred clay may be a bentonite clay. Highly preferred are smectite clays, as for example are disclosed in the U.S. Pat. Nos. 3,862,058 3,948,790, 3,954,632 and 4,062,647 and European Patents No.s EP-A-299,575 and EP-A-313,146 all in the name of the Procter and Gamble Company.

The term smectite clays herein includes both the clays in which aluminium oxide is present in a silicate lattice and the clays in which magnesium oxide is present in a silicate lattice. Typical smectite clay compounds include the compounds having the general formula $Al_2(Si_2O_5)_2(OH)_2.nH_2O$ and the compounds having the general formula $Mg_3(Si_2O_5)_2(OH)_2.nH_2O$. Smectite clays tend to adopt an expandable three layer structure.

Specific examples of suitable smectite clays include those selected from the classes of the montmorillonites, hectorites, volchonskoites, nontronites, saponites and sauconites, particularly those having an alkali or alkaline earth metal ion within the crystal lattice structure. Sodium or calcium montmorillonite are particularly preferred.

Suitable smectite clays, particularly montmorillonites, are sold by various suppliers including English China Clays, Laviosa, Georgia Kaolin and Colin Stewart Minerals.

Clays for use herein preferably have a largest particle dimension of from 0.01 $\mu$m to 800 $\mu$m, more preferably from 1 mm to 400 mm, most preferably from 5 mm to 200 mm.

Particles of the clay mineral compound may be included as components of agglomerate particles containing other detergent compounds. Where present as such components, the term "largest particle dimension" of the clay mineral compound refers to the largest dimension of the clay mineral component as such, and not to the agglomerated particle as a whole.

Substitution of small cations, such as protons, sodium ions, potassium ions, magnesium ions and calcium ions, and of certain organic molecules including those having positively charged functional groups can typically take place within the crystal lattice structure of the smectite clays. A clay may be chosen for its ability to preferentially absorb one cation type, such ability being assessed by measurements of relative ion exchange capacity. The smectite clays suitable herein typically have a cation exchange capacity of at least 50 meq/100 g. U.S. Pat. No. 3,954,632 describes a method for measurement of cation exchange capacity.

The crystal lattice structure of the clay mineral compounds may have, in a preferred execution, a cationic fabric softening agent substituted therein. Such substituted clays have been termed 'hydrophobically activated' clays. The cationic fabric softening agents are typically present at a weight ratio, cationic fabric softening agent to clay, of from 1:200 to 1:10, preferably from 1:100 to 1:20. Suitable cationic fabric softening agents include the water insoluble tertiary amines or dilong chain amide materials as disclosed in GB-A-1 514 276 and EP-B-0 011 340.

A preferred commercially available "hydrophobically activated" clay is a bentonite clay containing approximately 40% by weight of a dimethyl ditallow quaternary ammonium salt sold under the tradename Claytone EM by English China Clays International.

Organophilic clays may also be used herein. These are hydrophobically modified clays which have organic ions replacing inorganic metal ions by ion exchange processes known in the art. These kinds of clay are readily mixable with organic solvent and have the capability to absorb organic solvent at the interlayers. Suitable examples or organophilic clays useful in the invention are Bentone SD-1, SD-2 and SD-3 from Rheox of Highstown, N.J.

It may be optional that the clay, and optionally also the flocculating polymer, is present in a mixture with a wax and a structuring agent.

Flocculating Agent

The components of the invention may contain a clay flocculating agent, preferably present at a level of from 0.005% to 10%, more preferably from 0.05% to 5%, most preferably from 0.1% to 2% by weight of the component.

The clay flocculating agent functions such as to bring together the particles of clay compound in the wash solution and hence to aid their deposition onto the surface of the fabrics in the wash. This functional requirement is hence different from that of clay dispersant compounds which are commonly added to laundry detergent components to aid the removal of clay soils from fabrics and enable their dispersion within the wash solution.

Preferred as clay flocculating agents herein are organic polymeric materials having an average weight of from 100,000 to 10,000,000, preferably from 150,000 to 5,000,000, more preferably from 200,000 to 2,000,000.

Suitable organic polymeric materials comprise homopolymers or copolymers containing monomeric units selected from alkylene oxide, particularly ethylene oxide, acrylamide, acrylic acid, vinyl alcohol, vinyl pyrrolidone, and ethylene imine. Homopolymers of, on particular, ethylene oxide, but also acrylamide and acrylic acid are preferred.

European Patents No.s EP-A-299,575 and EP-A-313,146 in the name of the Procter and Gamble Company describe preferred organic polymeric clay flocculating agents for use herein.

Inorganic clay flocculating agents are also suitable herein, typical examples of which include lime and alum.

Carbonate Salts

Suitable alkali and/or earth alkali inorganic carbonate salts herein include carbonate and hydrogen carbonate and percarbonate of potassium, lithium, sodium, and the like amongst which sodium and potassium carbonate are preferred. Suitable bicarbonates to be used herein include any alkali metal salt of bicarbonate like lithium, sodium, potassium and the like, amongst which sodium and potassium bicarbonate are preferred. However, the choice of carbonate or bicarbonate or mixtures thereof in the dry effervescent granules may be made depending on the pH desired in the aqueous medium wherein the granules are dissolved. For example where a relative high pH is desired in the aqueous medium (e.g., above pH 9.5) it may be preferred to use carbonate alone or to use a combination of carbonate and bicarbonate wherein the level of carbonate is higher than the level of bicarbonate. The inorganic alkali and/or earth alkali carbonate salt of the components of the invention comprises preferably a potassium or more preferably a sodium salt of carbonate and/or bicarbonate. Preferably, the carbonate salt comprises sodium carbonate, optionally also a sodium bicarbonate.

In one embodiment of the invention, an effervescence source is present, preferably comprising an organic acid, such as carboxylic acids or aminoacids, and a carbonate. Then it may be preferred that part or all of the carbonate salt herein is premixed with the organic acid, and thus present in an separate granular component.

The carbonate may have any particle size. In one embodiment, in particular when the carbonate salt is present in a granule and not as separately added compound, the carbonate salt has preferably a volume median particle size from 5 to 375 microns, whereby preferably at least 60%, preferably at least 70% or even at least 80% or even at least 90% by volume, has a particle size of from 1 to 425 microns. More preferably, the carbon dioxide source has a volume median particle size of 10 to 250, whereby preferably at least 60%, or even at least 70% or even at least 80% or even at least 90% by volume, has a particle size of from 1 to 375 microns; or even preferably a volume median particle size from 10 to 200 microns, whereby preferably at least 60%, preferably at least 70% or even at least 80% or even at least 90% by volume, has a particle size of from 1 to 250 microns.

Builder Material

Preferred builders are alumniosilicate materials, such a s zeolites and/or phosphate salts.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid. The phosphate builder material most preferably comprises tetrasodium pyrophosphate or even more preferably anhydrous sodium tripolyphosphate.

Suitable aluminosilicate zeolites have the unit cell formula $Na_z[(AlO_2)_z(SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}].276H_2O$.

Another preferred aluminosilicate zeolite is zeolite MAP builder.

Zeolite MAP is described in EP 384070-A. It is defined as an alkali metal aluminosilicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometers, more preferably from 2.0 to 7.0 micrometers, most preferably from 2.5 to 5.0 micrometers.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Also preferred may be crystalline layered silicate material, such as SKS-6 (as sold by Clariant), and also amorphous silicates, preferably 1.6 or 2 ratio sodium silicates. The may be present as powdered material of low density, e.g. below 40 g/liter, or as compacted materials, e.g. of density of more than 400 g/liter, for example obtained by roller compaction. The may also be present in the form of a mixture with one another, or with other builder materials or inorganic salts.

The component may also preferably comprise water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under wash conditions are useful water-soluble builders herein.

Surfactant System

The component comprises a surfactant system. The surfactant system may contain any surfactant commonly employed in detergent compositions, such as anionic surfactants, nonionic surfactants, cationic surfactants, amphoteric surfactants, zwitterionic surfactants or mixtures thereof. As set out above, preferred is that at least an anionic sulphate and/or sulphonate surfactant is present. Also preferred are nonionic surfactants.

When cationic surfactants, zwitterionic surfactants or amphoteric surfactants are present, it may be preferred that at least an anionic surfactant or an nonionic surfactant is present as well.

Anionic Surfactant

Any anionic surfactant useful for detersive purposes is suitable. These can include salts (including, for example, sodium, potassium, ammonium, and substituted ammonium salts such as mono-, di- and triethanolamine salts) of the anionic sulfate, sulfonate, carboxylate and sarcosinate surfactants.

Anionic sulfonates surfactants are preferably present as the anionic surfactant or part of the anionic surfactants.

Other suitable anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

The performance benefits which result when an anionic surfactant is also used in the components of the invention are particularly useful for longer carbon chain length anionic surfactants such as those having a carbon chain length of $C_{12}$ or greater, particularly of $C_{14-15}$ or even up to $C_{16-18}$ carbon chain lengths.

Anionic Sulfate Surfactant

Anionic sulfate surfactants suitable for use in the components or components of the invention include the primary and secondary alkyl sulfates, having a linear or branched alkyl or alkenyl moiety having from 9 to 22 carbon atoms or more preferably $C_{12}$ to $C_{18}$ alkyl; alkyl ethoxysulfates; fatty oleoyl glycerol sulfates; alkyl phenol ethylene oxide ether sulfates; the $C_5$–$C_{17}$ acyl-N-($C_1$–$C_4$ alkyl) and —N-($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_9$–$C_{22}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of a $C_5$–$C_{20}$, more preferably a $C_{10}$–$C_{16}$, more preferably a $C_{11}$–$C_{13}$ (linear) alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

The alkyl ester sulfonated surfactant are preferably of the formula $$R^1—CH(SO_3M)—(A)_x—C(O)—OR^2$$

wherein $R^1$ is a $C_6$–$C_{22}$ hydrocarbyl, $R^2$ is a $C_1$–$C_6$ alkyl, A is a $C_6$–$C_{22}$ alkylene, alkenylene, x is 0 or 1, and M is a cation. The counterion M is preferably sodium, potassium or ammonium.

The alkyl ester sulfonated surfactant is preferably a α-sulpho alkyl ester of the formula above, whereby thus x is 0. Preferably, $R^1$ is an alkyl or alkenyl group of from 10 to 22, preferably 16 C atoms and x is preferably 0. $R^2$ is preferably ethyl or more preferably methyl.

It can be preferred that the R1 of the ester is derived from unsaturated fatty acids, with preferably 1, 2 or 3 double bonds. It can also be preferred that $R^1$ of the ester is derived from a natural occurring fatty acid, preferably palmic acid or stearic acid or mixtures thereof.

Dianionic Surfactants

Dianionic surfactants are also suitable anionic surfactants for use in the components or components of the present invention. Preferred are the dianionic surfactants of the formula:

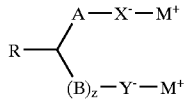

where R is an, optionally substituted, alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A nad B are independently selected from alkylene, alkenylene, (poly) alkoxylene, hydroxyalkylene, arylalkylene or amido alkylene groups of chain length Cl to $C_{28}$ preferably $C_1$ to $C_5$, most preferably $C_1$ or $C_2$, or a covalent bond, and preferably A and B in total contain at least 2 atoms; A, B, and R in total contain from 4 to about 31 carbon atoms; X and Y are anionic groups selected from the group comprising carboxylate, and preferably sulfate and sulfonate, z is 0 or preferably 1; and M is a cationic moiety, preferably a substituted or unsubstituted ammonium ion, or an alkali or alkaline earth metal ion.

The most preferred dianionic surfactant has the formula as above where R is an alkyl group of chain length from $C_{10}$ to $C_{18}$, A and B are independently $C_1$ or $C_2$, both X and Y are sulfate groups, and M is a potassium, ammonium, or a sodium ion.

Preferred dianionic surfactants herein include:

(a) 3 disulphate compounds, preferably 1,3 C7–C23 (i.e., the total number of carbons in the molecule) straight or branched chain alkyl or alkenyl disulphates, more preferably having the formula:

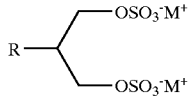

wherein R is a straight or branched chain alkyl or alkenyl group of chain length from about $C_4$ to about $C_{20}$;

(b) 1,4 disulphate compounds, preferably 1,4 C8–C22 straight or branched chain alkyl or alkenyl disulphates, more preferably having the formula:

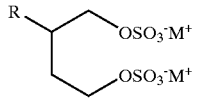

wherein R is a straight or branched chain alkyl or alkenyl group of chain length from about $C_4$ to about $C_{18}$; preferred R are selected from octanyl, nonanyl, decyl, dodecyl, tetradecyl, hexadecyl, octadecyl, and mixtures thereof; and (c) 1,5 disulphate compounds, preferably 1,5 C9–C23 straight or branched chain alkyl or alkenyl disulphates, more preferably having the formula:

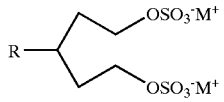

wherein R is a straight or branched chain alkyl or alkenyl group of chain length from about $C_4$ to about $C_{18}$.

It can be preferred that the dianionic surfactants are alkoxylated dianionic surfactants.

A preferred alkoxylated dianionic surfactant has the formula

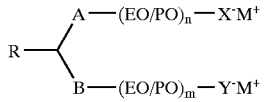

where R is an, optionally substituted, alkyl, alkenyl, aryl, alkaryl, ether, ester, amine or amide group of chain length $C_1$ to $C_{28}$, preferably $C_3$ to $C_{24}$, most preferably $C_8$ to $C_{20}$, or hydrogen; A and B are independently selected from, optionally substituted, alkyl and alkenyl group of chain length $C_1$ to $C_{28}$, preferably $C_1$ to $C_5$, most preferably $C_1$ or $C_2$, or a covalent bond; EO/PO are alkoxy moieties selected from ethoxy, propoxy, and mixed ethoxy/propoxy groups, wherein n and m are independently within the range of from about 0 to about 10, with at least m or n being at least 1; A and B in total contain at least 2 atoms; A, B, and R in total contain from 4 to about 31 carbon atoms; X and Y are anionic groups selected from the group consisting of sulphate and sulphonate, provided that at least one of X or Y is a sulfate group; and M is a cationic moiety, preferably a substituted or unsubstituted ammonium ion, or an alkali or alkaline earth metal ion.

The most preferred alkoxylated dianionic surfactant has the formula as above where R is an alkyl group of chain length from $C_{10}$ to $C_{18}$, A and B are independently $C_1$ or $C_2$, n and m are both 1, both X and Y are sulfate groups, and M is a potassium, ammonium, or a sodium ion.

Mid-chain Branched Alkyl Sulfates or Sulphonates

Mid-chain branched alkyl sulfates or sulphonates are also suitable anionic surfactants for use in the components or components of the invention. Preferred are the mid-chain branched alkyl sulfates.

Preferred mid-chain branched primary alkylsulfate surfactants are of the formula

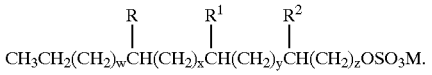

$$CH_3CH_2(CH_2)_wCH(R)(CH_2)_xCH(R^1)(CH_2)_yCH(R^2)(CH_2)_zOSO_3M.$$

These surfactants have a linear primary alkyl sulfate chain backbone (i.e., the longest linear carbon chain which includes the sulfated carbon atom) which preferably comprises from 12 to 19 carbon atoms and their branched primary alkyl moieties comprise preferably a total of at least 14 and preferably no more than 20, carbon atoms. In components or components thereof of the invention comprising more than one of these sulfate surfactants, the average total number of carbon atoms for the branched primary alkyl moieties is preferably within the range of from greater than 14.5 to about 17.5. Thus, the surfactant system preferably comprises at least one branched primary alkyl sulfate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to about 17.5.

Preferred mono-methyl branched primary alkyl sulfates are selected from the group consisting of: 3-methyl pentadecanol sulfate, 4-methyl pentadecanol sulfate, 5-methyl pentadecanol sulfate, 6-methyl pentadecanol sulfate, 7-methyl pentadecanol sulfate, 8-methyl pentadecanol sulfate, 9-methyl pentadecanol sulfate, 10-methyl pentadecanol sulfate, 11-methyl pentadecanol sulfate, 12-methyl pentadecanol sulfate, 13-methyl pentadecanol sulfate, 3-methyl hexadecanol sulfate, 4-methyl hexadecanol sulfate, 5-methyl hexadecanol sulfate, 6-methyl hexadecanol sulfate, 7-methyl hexadecanol sulfate, 8-methyl hexadecanol sulfate, 9-methyl hexadecanol sulfate, 10-methyl hexadecanol sulfate, 11-methyl hexadecanol sulfate, 12-methyl hexadecanol sulfate, 13-methyl hexadecanol sulfate, 14-methyl hexadecanol sulfate, and mixtures thereof.

Preferred di-methyl branched primary alkyl sulfates are selected from the group consisting of: 2,3-methyl tetradecanol sulfate, 2,4-methyl tetradecanol sulfate, 2,5-methyl tetradecanol sulfate, 2,6-methyl tetradecanol sulfate, 2,7-methyl tetradecanol sulfate, 2,8-methyl tetradecanol sulfate, 2,9-methyl tetradecanol sulfate, 2,10-methyl tetradecanol sulfate, 2,11-methyl tetradecanol sulfate, 2,12-methyl tetradecanol sulfate, 2,3-methyl pentadecanol sulfate, 2,4-methyl pentadecanol sulfate, 2,5-methyl pentadecanol sulfate, 2,6-methyl pentadecanol sulfate, 2,7-methyl pentadecanol sulfate, 2,8-methyl pentadecanol sulfate, 2,9-methyl pentadecanol sulfate, 2,10-methyl pentadecanol sulfate, 2,11-methyl pentadecanol sulfate, 2,12-methyl pentadecanol sulfate, 2,13-methyl pentadecanol sulfate, and mixtures thereof.

The following branched primary alkyl sulfates comprising 16 carbon atoms and having one branching unit are examples of preferred branched surfactants useful in the present invention components:

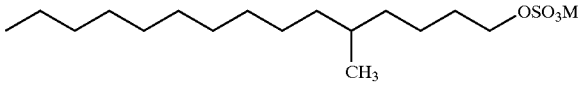

5-methylpentadecylsulfate having the formula

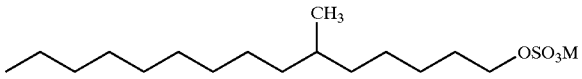

6-methylpentadecylsulfate having the formula

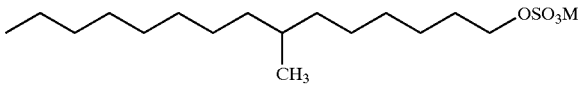

7-methylpentadecylsulfate having the formula

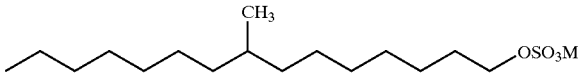

8-methylpentadecylsulfate having the formula

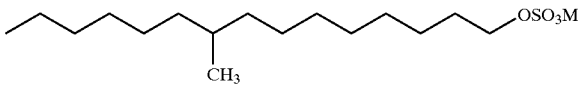

9-methylpentadecylsulfate having the formula

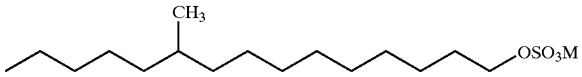

10-methylpentadecylsulfate having the formula wherein M is preferably sodium.

The following branched primary alkyl sulfates comprising 17 carbon atoms and having two branching units are examples of preferred branched surfactants according to the present invention:

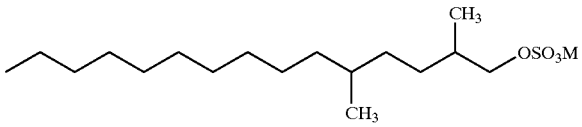

2,5-methylpentadecylsulfate having the formula

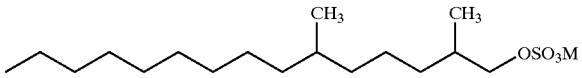

2,6-methylpentadecylsulfate having the formula

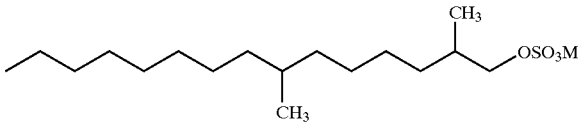

2,7-methylpentadecylsulfate having the formula

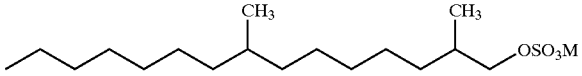

2,8-methylpentadecylsulfate having the formula

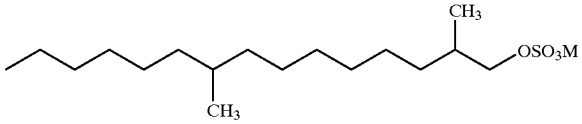

2,9-methylpentadecylsulfate having the formula

-continued

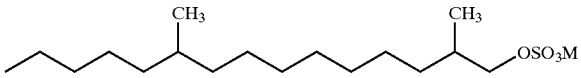

2,10-methylpentadecylsulfate having the formula wherein M is preferably sodium.

Anionic Carboxylate Surfactant

Suitable anionic carboxylate surfactants include the alkyl ethoxy carboxylates, the alkyl a polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x CH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Certain soaps may also be included as suds suppressors.

Alkali Metal Sarcosinate Surfactant

Other suitable anionic surfactants are the alkali metal sarcosinates of formula $R\text{-}CON(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Nonionic Surfactant System

The detergent component may comprise or also comprise a nonionic surfactant system comprising at least two nonionic alkoxylated surfactants.

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic alkoxylated fatty acid amides, nonionic ethoxylated/propoxylated fatty alcohols, nonionic ethoxylate/propoxylate condensates with propylene glycol, and the nonionic ethoxylate condensation products with propylene oxide/ethylene diamine adducts.

Preferably, at least one of the nonionic surfactants is an alkoxylated alcohol surfactant as described herein after.

Also, preferred are nonionic alkoxylated fatty acid amides, which can provide even more additional softening to the fabric, or to the skin when the detergent is in contact with the skin.

Most preferred is a nonionic surfactant system which comprises at least two nonionic alkoxylated alcohol surfactants whereof preferably one surfactant has an average alkoxylation degree of 5 or less and one surfactant has an average alkoxylation degree of more than 5. Highly preferred are systems comprising at least a nonionic alkoxylated alcohol with an average alkoxylation degree of 3 or 5 and at least one nonionic alkoxylated alcohol having an average alkoxylation degree of from 5.5 to 15, preferably 6 or 9.

The alkoxylation groups of the nonionic surfactants preferably are propoxylate groups, more preferably ethoxylate groups.

The condensation products of aliphatic alcohols with from 1 to 25 moles of alkylene oxide, particularly ethylene oxide and/or propylene oxide, are preferred in the nonionic surfactant system herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms.

The nonioninc surfactant system of the invention may comprise an alkoxylated fatty acid amide, which comprises preferably a compound of the formula

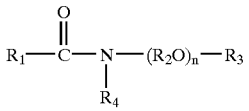

wherein $R_1$ is a $C_{12}$–$C_{18}$ alkyl or alkenyl group, $R_2$ is a $C_2$–$C_4$ alkylene group, $R_3$ is a hydrogen or a $C_1$–$C_4$ alkyl group, $R_4$ is a $C_1$–$C_4$ alkyl group or hydrogen and n is a number from 3 to 12.

Preferred alkoxylated fatty acid amides have a $R_1$ being a $C_{12}$–$C_{14}$ or a $C_{16}$–$C_{18}$ alkyl group, $R_2$ being a propylene or more preferably ethylene, n being from 5 to 10, $R_4$ being methyl or hydrogen, $R_3$ being hydrogen, or a methyl or ethyl group.

The detergent components herein may also comprise additionally non-alkoxylated nonionic surfactnats including polyhydroxy fatty acid amides. Those suitable for use herein have the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight n $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

The detergent components herein may also comprise additionally alkyl-polysaccharides, such as are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(glycosyl)_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is go from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(™) $C_2M$ Conc. manufactured by Miranol, Inc., Dayton, N.J.

Zwitterionic Surfactant

Zwitterionic surfactants can also be incorporated into the detergent components in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Cationic Surfactants

Suitable cationic surfactants to be used in the detergent herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent components or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic Mono-alkoxylated Amine Surfactants

Highly preferred herein are cationic mono-alkoxylated amine surfactant preferably of the general formula I:

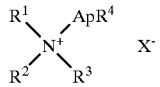

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —$CH_2CH_2OH$, —$CH_2CH_2CH_2OH$, —$CH_2CH(CH_3)OH$ and —$CH(CH_3)CH_2OH$, with —$CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

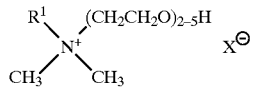

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent components of the invention is preferably from 0.5% to 30%, more preferably from 1% to 25%, most preferably from 1% to 10% by weight of the component.

Cationic bis-Alkoxylated Amine Surfactant

The cationic bis-alkoxylated amine surfactant preferably has the general formula II:

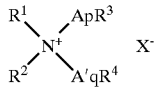

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, X is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

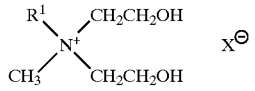

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

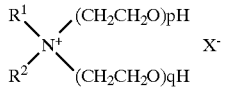

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Other Ingredients of the Component and Compositions Containing the Component

The component may comprise additional ingredients. These ingredients are preferably ingredients commonly employed in laundry detergents or laundry softeners, as described herein after.

The fabric softening component of the invention may be present in a detergent composition or softening compositions. These compositions are preferably solid, in the form of granules, extrudates, flakes, bars or tablets.

The compositions can be used in automatic washing or hand washing. Also, the compositions can be such that they are suitable for pre-treatment or soaking, or for rinsing or conditioning of the fabric after the main wash.

The compositions in accord with the invention may also contain additional detergent components. The precise nature of these additional components, and levels of incorporation thereof will depend on the physical form of the composition or component, and the precise nature of the washing operation for which it is to be used.

The compositions of the invention preferably contain one or more additional detergent components selected from additional surfactants, as described above, bleaches, bleach catalysts, alkalinity systems, additional builders, additional organic polymeric compounds, enzymes, suds suppressers, soaps, lime soap, dispersants, soil suspension and anti-redeposition agents soil releasing agents, perfumes, brighteners, photo-bleaching agents and additional corrosion inhibitors.

Highly preferred additional ingredients are soil release polymers, in particular polyesters or polysaccherides or derivatives thereof cellulose based polymers, including carboxy methyl cellulose, cellulose ethers or ester or amine or amide modified celluloses, encapsulated perfumes, effervescence sources, preferably based on carbonate and acid compounds, in particular citric acid, malic acid or maleic acid, phosphonate-builders, dye transfer inhibitors, and process aids such as hydrotropes. These ingredients are described in more detail herein.

Highly preferred may be to include a carboxy methyl cellulose compound at a level of at least 0.5% or even 0.75% or even 1% by weight of the composition, or alternatively, or in addition a polysaccheride at a level of at least 0.5% or even 0.75% or even 1% by weight of the composition.

It may be preferred that the compositions comprise a cationic softener. Highly preferred water-insoluble quaternary ammonium compounds are those having two $C_{12}$–$C_{24}$ alkyl or alkenyl chains, optionally substituted by functional groups such as —OH, —O—, —CONH, —COO etc.

Well known species of substantially water-insoluble quaternary ammonium compounds have the formula $$R_1R_2R_3R_4N\ X$$

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethylammonium chloride; ditallow dimethyl ammonium methyl sulfate; dihexadecyl dimethyl ammonium chloride; di(hydrogenated tallow alkyl)dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimehtyl ammonium methosulfate are preferred.

Also suitable herein are the imidaxolinium fabric softening components of U.S. Pat. No. 4,127,489, incorporated by reference. As used herein the term "fabric softening agent" excludes, cationic detergent active materials which have a solubility above 10 g/l in water at 20° C. at a pH of about 6.

Especially preferred is ditallowyl methylamine. This is commercially available as Armeen M2HT from AKZO NV, as Genamin SH301 from FARBWERKE HOECHST, and as Noram M2SH from the CECA COMPANY.

Perhydrate Bleaches

An preferred additional components of the components or composition is a perhydrate bleach, such as metal perborates, metal percarbonates, particularly the sodium salts. Perborate can be mono or tetra hydrated. Sodium percarbonate has the formula corresponding to $2Na_2CO_3.3H_2O_2$, and is available commercially as a crystalline solid.

Potassium peroxymonopersulfate, sodium per is another optional inorganic perhydrate salt of use in the detergent components herein.

Organic Peroxyacid Bleaching System

A preferred feature of the composition or component is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

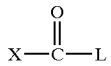

where L is a leaving group and X is essentially any functionality, such that on perhydroloysis the structure of the peroxyacid produced is

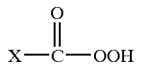

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

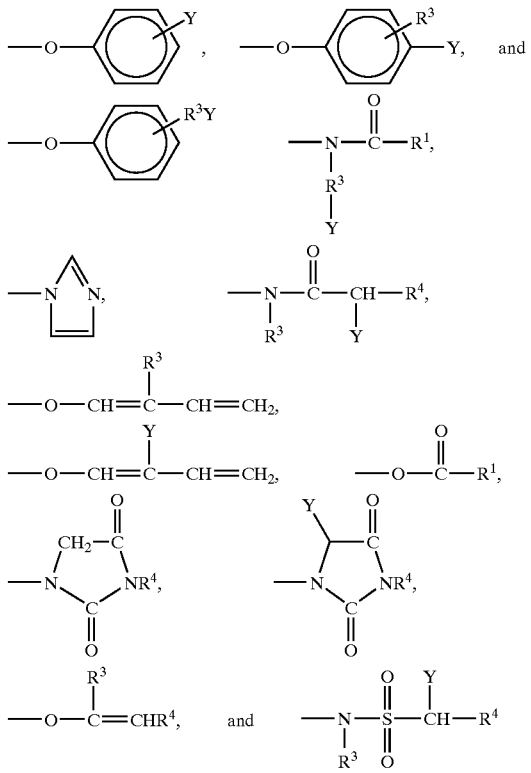

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammmomnium groups.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are suitable herein, including those of the following general formulae:

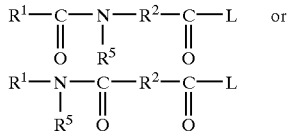

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Preformed Organic Peroxyacid

The organic peroxyacid bleaching system may contain, in addition to, or as an alternative to, an organic peroxyacid bleach precursor compound, a preformed hydrophobic organic peroxyacid, typically at a level of from 0.05% to 20% by weight, more preferably from 1% to 10% by weight of the composition.

A preferred class of hydrophobic organic peroxyacid compounds are the amide substituted compounds of the following general formulae:

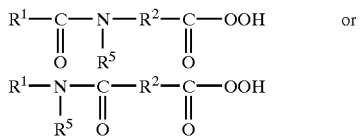

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386. Suitable examples of this class of agents include (6 octylamino)-6-oxo-caproic acid, (6-nonylamino)-6-oxo-caproic acid, (6-decylamino)-6-oxo-caproic acid, magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, U.S. Pat. No. 4,634,551, EP 0,133,354, U.S. Pat. No. 4,412,934 and EP 0,170,386. A preferred hydrophobic preformed peroxyacid bleach compound for the purpose of the invention is mononononylamido peroxycarboxylic acid.

Other suitable organic peroxyacids include diperoxyalkanedioc acids having more than 7 carbon atoms, such as diperoxydodecanedioc acid, diperoxytetradecanedioc acid and diperoxyhexadecanedioc acid.

Other suitable organic peroxyacids include diamino peroxyacids, which are disclosed in WO 95/03275, with the following general formula:

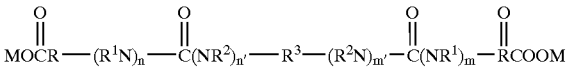

wherein:

R is selected from the group consisting of $C_1$–$C_{12}$ alkylene, $C_5$–$C_{12}$ cycloalkylene, $C_6$–$C_{12}$ arylene and radical combinations thereof;

$R^1$ and $R^2$ are independently selected from the group consisting of H, $C_1$–$C_{16}$ alkyl and $C_6$–$C_{12}$ aryl radicals and a radical that can form a $C_3$–$C_{12}$ ring together with $R^3$ and both nitrogens; $R^3$ is selected from the group consisting of $C_1$–$C_{12}$ alkylene, $C_5$–$C_{12}$ cycloalkylene and $C_6$–$C_{12}$ arylene radicals; n and n' each are an integer chosen such that the sum thereof is 1; m and m' each are an integer chosen such that the sum thereof is 1; and M is selected from the group consisting of H, alkali metal, alkaline earth metal, ammonium, alkanolammonium cations and radicals and combinations thereof.

Other suitable organic peroxyacids are include the amido peroxyacids which are disclosed in WO 95/16673, with the following general structure:

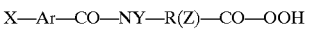

in which X represents hydrogen or a compatible substituent, Ar is an aryl group, R represents $(CH_2)n$ in which n=2 or 3, and Y and Z each represent independently a substituent selected from hydrogen or an alkyl or aryl or alkaryl group or an aryl group substituted by a compatible substituent provided that at least one of Y and Z is not hydrogen if n=3. The substituent X on the benzene nucleus is preferably a hydrogen or a meta or para substituent, selected from the group comprising halogen, typically chlorine atom, or some other non-released non-interfering species such as an alkyl group, conveniently up to C6 for example a methyl, ethyl or propyl group. Alternatively, X can represent a second amido-percarboxylic acid substituent of formula:

—CO—NY—R(Z)—CO—OOH in which R, Y, Z and n are as defined above.

MOOC—$R^1$CO—$NR^2$—$R^3$—$NR^4$–CO—$R^5$COOOM wherein $R^1$ is selected from the group consisting of $C_1$–$C_{12}$ alkylene, $C_5$–$C_{12}$ cycloalkylene, $C_6$–$C_{12}$ arylene and radical combinations thereof; R Highly preferred herein is phthaloylamido peroxyacid (PAP).

Bleach Catalyst

The composition or component can contain a transition metal containing bleach catalyst.

One suitable type of bleach catalyst is a catalyst system comprising a transition metal cation of defined bleach catalytic activity, such as copper, iron or manganese cations, an to auxiliary metal cation having little or no bleach catalytic activity, such as zinc or w aluminum cations, and a sequestrant having defined stability constants for the catalytic and auxiliary metal cations, particularly ethylenediaminee-traacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn^{IV}{}_2$(u-O)$_3$(1,4,7-trimethyl-1,4,7-triazacyclononane)2-$(PF_6)_2$, $Mn^{III}{}_2$(u-O)$_1$(u-OAc)$_2$(1,4,7-trimethyl-1,4,7-triazacyclononane)$_2$-$(ClO_4)_2$, $Mn^{IV}{}_4$(u-O)$_6$(1,4,7-triazacyclononane)$_4$-$(ClO_4)_2$, $Mn^{III}Mn^{IV}{}_4$(u-O)$_1$(u-OAc)$_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

The bleach catalysts useful herein may also be selected as appropriate for the present invention. For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

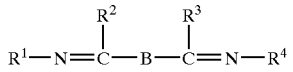

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S, $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrinidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include binuclear Mn complexed with tetra-N-dentate and bi-N-dentate ligands, including $N_4Mn^{III}$(u-O)$_2Mn^{IV}N_4)^+$ and $[Bipy_2Mn^{III}$(u-O)$_2Mn^{IV}bipy_2](ClO_4)_3$.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

The bleach catalyst is typically used in a catalytically effective amount in the compositions and processes herein. By "catalytically effective amount" is meant an amount which is sufficient, under whatever comparative test conditions are employed, to enhance bleaching and removal of the stain or stains of interest from the target substrate. The test conditions will vary, depending on the type of washing appliance used and the habits of the user. Some users elect to use very hot water, others use warm or even cold water in laundering operations. Of course, the catalytic performance of the bleach catalyst will be affected by such considerations, and the levels of bleach catalyst used in fully-formulated detergent and bleach compositions can be appropriately adjusted. As a practical matter, and not by way of limitation, the compositions and processes herein can be adjusted to provide on the order of at least one part per ten million of the active bleach catalyst species in the aqueous washing liquor, and will preferably provide from about 1 ppm to about 200 ppm of the catalyst species in the wash liquor. To illustrate this point further, on the order of 3 micromolar manganese catalyst is effective at 40° C., pH 10 under European conditions using perborate and a bleach precursor. An increase in concentration of 3–5 fold may be required under U.S. conditions to achieve the same results.

Heavy Metal Ion Sequestrant

The compositions or component of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component Suitable heavy metal ion sequestrants for use herein include organic phosphonates, such as the amino allylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Enzyme

Another preferred ingredient useful in the components or compositions herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635, and in WO95/26397 and WO96/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Additional Organic Polymeric Compound

Additional organic polymeric compounds are preferred additional components of the compositions or components herein and are preferably present as components of any particulate components where they may act such as to bind the particulate component together. By organic polymeric compound it is meant herein essentially any polymeric organic compound commonly used as dispersants, and anti-redeposition and soil suspension agents in detergent composition.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Polyethylene oxides are preferred additional ingredients, in particular present in a particle with the clay herein, as a humectant, preferably also combined with a wax or oil.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No. 60/051517.

Another organic compound, which is a preferred clay dispersant/anti-redeposition agent, for use herein, can be the ethoxylated cationic monoamines and diamines of the formula:

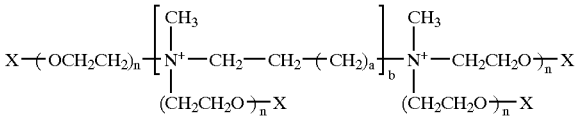

wherein X is a nonionic group selected from the group consisting of H, $C_1$–$C_4$ alkyl or hydroxyalkyl ester or ether groups, and mixtures thereof a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-01 1965 and U.S. Pat. No. 4,659,802 and U.S. Pat. No. 4,664,848.

Suds Suppressing System

The detergent compositions or the components of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Also highly preferred is the presence of soap.

Polymeric Dye Transfer Inhibiting Agents

The component or compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The components but also the compositions herein preferably contain from about 0.05% to 5%, more preferably from 0.07 to 3% or even 0.1% to 2.5% by weight of the component or from about 0.05% to 5%, more preferably from 0.1 to 3% or even 0.12% to 2.5% by weight of composition of certain types of hydrophilic optical brighteners.

Hydrophilic optical brighteners useful herein include those having the structural formula:

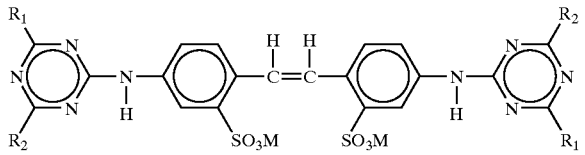

wherein $R^1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R^1$ is anilino, $R^2$ is N-2-hydroxyethyl-N-2-methylamino and M is a cation such as sodium, the brightener is 4,4'-bis[(4-anilino-6(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

Polymeric Soil Release Agent

Polymeric soil release agents, hereinafter "SRA", can optionally be employed in the present compositions or components. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by tansesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK. Also highly preferred are polysaccheride polymers.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.

Other Optional Ingredients

Other optional ingredients suitable for inclusion in the compositions or components of the invention include perfumes, colours and other filler salts as replacement for sulphate filler salt.

Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides, photo-bleaches, speckles, dyes, such as those described in U.S. Pat. No. 4,285,841 to Barrat et al., issued Aug. 25, 1981 (herein incorporated by reference), can be present.

Form of the Compositions

The composition of the invention can be made via a variety of methods, including dry-mixing, agglomerating, compaction, or spray-drying of the various compounds comprised in the detergent component, or mixtures of these techniques.

The compositions herein can take a variety of physical forms including liquid, but preferably solid forms such as tablet, flake, pastille and bar, and preferably granular forms.

The compositions in accord with the present invention can also be used in or in combination with bleach additive compositions, for example comprising chlorine bleach.

Detergent compositions herein, in particular laundry detergents, preferably have a bulk density of from 280 g/liter to 200 g/liter, or preferably from 300 g/liter or even 350 g/liter or 420 g/liter to 2000 g/liter or more preferably to 1500 g/liter or 100 g/liter or even to 700 g/liter.

Chlorine-based Bleach

The detergent compositions can include as an additional component a chlorine-based bleach. However, since preferred detergent compositions of the invention are solid, most liquid chlorine-based bleaching will not be suitable for these detergent compositions and only granular or powder chlorine-based bleaches will be suitable.

Alternatively, the detergent compositions can be formulated such that they are chlorine-based bleach-compatible, thus ensuring that a chlorine based bleach can be added to the detergent composition by the user at the beginning or during the washing process.

The chlorine-based bleach is such that a hypochlorite species is formed in aqueous solution. The hypochlorite ion is chemically represented by the formula $OCl^-$.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-chloro-5,5-dimethylhydantoin, N-chlorosulfamide, Chloramine T, Dichloramine T, chloramine B and Dichloramine B. A preferred bleaching agent for use in the compositions of the instant invention is sodium hypochlorite, potassium hypochlorite, or a mixture thereof. A preferred chlorine-based bleach can be Triclosan (trade name).

Most of the above-described hypochlorite-yielding bleaching agents are available in solid or concentrated form and are dissolved in water during preparation of the compositions of the instant invention. Some of the above materials are available as aqueous solutions.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods.

The compositions herein can be useful in both conventional washing machines and low-water fill washing machines.

In a preferred use aspect the composition hand washing. In another preferred aspect the detergent composition is a pre-treatment or soaking composition, to be used to pre-treat or soak soiled and stained fabrics.

Abbreviations Used in Examples

In the detergent compositions, the abbreviated component identifications have the following meanings:

| | |
|---|---|
| LAS | Sodium linear $C_{11-13}$ alkyl benzene sulfonate |
| TAS | Sodium tallow alkyl sulfate |
| CxyAS | Sodium $C_{1x}$–$C_{1y}$ alkyl sulfate |
| C46SAS | Sodium $C_{14}$–$C_{16}$ secondary (2,3) alkyl sulfate |
| CxyEzS | Sodium $C_{1x}$–$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_{12}$–$C_{14}$ |
| QAS 1 | $R_2.N^+(CH_3)_2(C_2H_4OH)$ with $R_2 = C_8$–$C_{11}$ |
| SADS | Sodium $C_{14}$–$C_{22}$ alkyl disulfate of formula 2-(R).$C_4H_7$.-1,4-$(SO_4\text{-})_2$ where R = $C_{10}$–$C_{18}$ |
| SADE2S | Sodium $C_{14}$–$C_{22}$ alkyl disulfate of formula 2-(R).$C_4H_7$.-1,4-$(SO_4\text{-})_2$ where R = $C_{10}$–$C_{18}$ , condensed with z moles of ethylene oxide |

-continued

| | |
|---|---|
| MES | x-sulpho methylester of $C_{18}$ fatty acid |
| APA | $C_8$–$C_{10}$ amido propyl dimethyl amine |
| Soap | Sodium linear alkyl carboxylate derived from an 80/20 mixture of tallow and coconut fatty acids |
| STS | Sodium toluene sulphonate |
| CFAA | $C_{12}$–$C_{14}$ (coco) alkyl N-methyl glucamide |
| TFAA | $C_{16}$–$C_{18}$ alkyl N-methyl glucamide |
| TPKFA | $C_{16}$–$C_{18}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6 | Crystalline layered silicate of formula δ-$Na_2Si_2O_5$ |
| Citric acid | Anhydrous citric acid |
| Borate | Sodium borate |
| Carbonate | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate ($SiO_2$:$Na_2O$ = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Amylase II | Amylolytic enzyme, as disclosed in PCT/US9703635 |
| Lipase | Lipolytic enzyme, having 2.0% by weight of active enzyme, sold by NOVO Industries A/S under the tradename Lipolase |
| Lipase II | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| DOBS | Decanoyl oxybenzene sulfonate in the form of the sodium salt |
| DPDA | Diperoxydodecanedioc acid |
| NOBS | Nonanoyloxybenzene sulfonate in the form of the sodium salt |
| NACA-OBS | (6-nonamidocaproyl) oxybenzene sulfonate |
| LOBS | Dodecanoyloxybenzene sulfonate in the form of the sodium salt |
| DOBS | Decanoyloxybenzene sulfonate in the form of the sodium salt |
| DOBA | Decanoyl oxybenzoic acid |
| TAED | Tetraacetylethylenediamine |
| DTPA | Diethylene triamine pentaacetic acid |

-continued

| | |
|---|---|
| DTPMP | Diethylene triamine penta (methylene phosphonate), marketed by Monsanto under the Tradename Dequest 2060 |
| EDDS | Ethylenediamine-N,N'-disuccinic acid, (S, S) isomer in the form of its sodium salt. |
| Photoactivated bleach (1) | Sulfonated zinc phthlocyanine encapsulated in dextrin soluble polymer |
| Photoactivated bleach (2) | Sulfonated alumino phthlocyanine encapsulated in dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidasole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | bis($(C_2H_5O)(C_2H_4O)_n$)($CH_3$)—$N^+$—$C_6H_{12}$—$N^+$—($CH_3$) bis($(C_2H_5O)$-$(C_2H_4O)$)$_n$, wherein n = from 20 to 30 |
| PEI | Polyethyleneimine with an average molecular weight of 1800 and an average ethoxylation degree of 7 ethyleneoxy residues per nitrogen |
| Clay I | Bentonite clay |
| Clay II | Smectite clay |
| Flocculating agent I | polyethylene oxide of average molecular weight of between 200,000 and 400,000 |
| Flocculating agent II | polyethylene oxide of average molecular weight of between 400,000 and 1,000,000 |
| Flocculating agent III | polymer of acrylamide and/or acrylic acid of average molecular weight of 200,000 and 400,000 |
| SRP I | Anionically end-capped polyester soil release polymer |
| SRP II | Polysaccheride soil release polymer |
| SRP 1 | Nonionically end capped poly esters |
| SRP 2 | Diethoxylated poly (1,2 propylene terephtalate) short block polymer |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |
| Speckle | Coloured carbonate salt or organic carboxylic acid/salt |

The following are components in accord with the invention (in weight % by weight of component):

| | Component | | | | | | | | | | | |
|---|---|---|---|---|---|---|---|---|---|---|---|---|
| | I | II | III | IV | V | VI | VII | VIII | IX | X | XI | XII |
| Clay I and/or II | 10.0 | 15.0 | 8.0 | 7.0 | 5.0 | 10.0 | 20.0 | 25.0 | 8.0 | 10.0 | 10.0 | 15.0 |
| Flocculating agent I or II | 0.1 | 0.5 | 1.0 | 2.0 | 2.5 | 1.0 | 3.0 | 0.2 | 0.1 | 1.0 | 0.5 | 2.0 |
| LAS | 10.0 | 8.0 | 18.0 | 20.0 | — | — | — | — | 30.0 | 35.0 | — | 18.0 |
| TAS | 2.0 | — | — | — | 3.0 | 6.0 | — | — | — | — | — | — |
| C24AS | 2.0 | — | 4.0 | — | 10.0 | 20 | — | — | — | — | — | — |
| MBAS | — | — | — | — | 5.0 | — | — | — | — | — | 12.0 | — |
| C24E7 or E9 | — | — | — | — | 2.0 | — | 6.0 | — | — | 2.0 | — | — |
| C24B3 or E4 | — | — | — | — | 2.0 | | | 6.0 | — | — | — | 2.0 |
| QAS | 1.0 | — | — | — | — | — | — | 2.0 | — | 4.0 | — | — |
| malic acid | — | 2.0 | — | | 2.0 | — | — | 2.0 | — | 5.0 | — | — |
| citric acid | — | — | 4.0 | — | — | — | — | | 5.0 | — | — | — |
| carbonate | 10.0 | 15.0 | 10.0 | 12.0 | 4.0 | — | 20.0 | 10.0 | 5.0 | 5.0 | 5.0 | — |
| bicarbonate | — | — | — | — | 6.0 | — | — | — | — | — | — | — |
| zeolite A or MAP | 15.0 | — | — | — | 20.0 | — | — | — | — | 20.0 | 15.0 | 5.0 |
| STPP | — | 10.0 | 15.0 | 30 | — | 18.0 | 15.0 | 20.0 | 30.0 | — | — | 5.0 |
| silicate | 5.0 | 10 | 5.0 | | 7.0 | — | — | 4.0 | 2.0 | — | 5.0 | — |
| SKS-6 | 2.0 | — | — | — | — | — | 5.0 | — | — | 5.0 | — | — |
| MA/AA | 1.0 | — | — | — | — | — | — | — | — | 1.0 | 1.0 | — |
| sulphate | — | — | — | — | — | 5.0 | — | — | — | — | 5.0 | — |
| brightener | 0.1 | 0.1 | 0.05 | 0.2 | 0.5 | 0.3 | — | 0.1 | — | 0.8 | 1.0 | — |
| SRP | — | — | — | — | — | 1.5 | — | — | — | 0.8 | — | — |
| TAED | — | — | 5.0 | — | — | — | — | — | — | — | — | |
| Desiccant# | — | — | 2.0 | — | 2.0 | — | — | — | — | — | — | — |
| HEDP/EDDS | — | — | — | — | 0.5 | — | — | 2.0 | 1.0 | — | — | 0.8 |
| STS | 0.5 | 0.7 | — | — | — | 1.0 | 2.0 | — | — | — | 2.0 | — |
| CMC | — | — | — | — | — | 1.2 | — | — | — | — | 1.0 | 0.5 |
| percarbonate | — | — | 7.0 | — | — | 3.0 | — | — | — | — | 10.0 | — |
| sudsuppressor/soap | 0.5 | 0.5 | — | — | 0.5 | 1.0 | 0.8 | 0.5 | — | — | 2.0 | — |
| enzyme moisture | 1.0 | — | — | — | — | — | — | 1.0 | 2.0 | — | — | — |
| perfume | — | — | 1.0 | 2.0 | 0.5 | — | — | — | 0.8 | 2.0 | — | — |
| PEG 4000 | — | 1.0 | — | — | — | 1.0 | — | — | — | — | — | — |

#(overdried or anhydrous salts/zeolite or overdried zeolite or silica

In the following examples all levels are quoted as % by weight of the composition:

EXAMPLE 1

The following detergent formulations in the form of a tablet, bar or granular formulation are in accord with the invention.

| | A | B | C | D |
|---|---|---|---|---|
| Component I–XII | balance | balance | balance | balance |
| Spray on | | | | |
| Brightener | 0.02 | — | — | 0.02 |
| C45E7 or E9 | — | — | 2.0 | 1.0 |
| C45E3 or E4 | — | — | 2.0 | 4.0 |
| Perfume | 0.5 | — | 0.5 | 0.2 |
| Silicone antifoam | 0.3 | — | — | — |
| Dry additives | | | | |
| QEA | — | — | — | 1.0 |
| HEDP/EDDS | 0.3 | — | 0.5 | 0.5 |
| Sulfate | 2.0 | — | 0.5 | 1.0 |
| Carbonate | 2.0 | 10. | 15.0 | 12.0 |
| Citric acid | 2.5 | — | — | 2.0 |
| QAS | — | — | 0.5 | 0.5 |
| SKS-6 | 3.5 | — | — | 5.0 |
| Percarbonate | — | — | 15.0 | 9.0 |
| PB4 | — | — | — | 3.0 |
| TAED/NOBS | — | — | — | 5.0 |

-continued

| | A | B | C | D |
|---|---|---|---|---|
| PAP | — | — | 2.0 | — |
| Protease | 1.0 | 1.0 | 1.0 | 1.0 |
| Lipase | — | 0.4 | — | 0.2 |
| Amylase | 0.2 | 0.2 | 0.2 | 0.4 |
| Brightener | 0.05 | — | — | 0.05 |
| Perfume | 1.0 | 0.2 | 0.5 | 0.3 |
| Speckle | 1.2 | 0.5 | 2.0 | — |
| Misc/minor to 100% | | | | |

EXAMPLE 2

The following detergent formulations in the form of a tablet, bar or granular formulation are in accord with the invention.

| | E | F | G | H | I | J |
|---|---|---|---|---|---|---|
| Component I–XII | balance | balance | balance | balance | balance | balance |
| Spray on | | | | | | |
| C45E7 | — | 2.0 | — | — | 2.0 | 2.0 |
| C25E9 | 3.0 | — | — | — | — | — |
| C23E9 | — | — | 1.5 | 2.0 | — | 2.0 |

-continued

| | E | F | G | H | I | J |
|---|---|---|---|---|---|---|
| Perfume | 0.3 | 0.3 | 0.3 | 2.0 | 0.3 | 0.3 |
| Agglomerates | | | | | | |
| C45AS | 5.0 | 5.0 | — | 2.0 | 5.0 | — |
| LAS | 2.0 | 2.0 | 7.0 | — | — | 8.0 |
| STPP/Zeolite A | 7.5 | 7.5 | 7.5 | 8.0 | 7.5 | 7.5 |
| Carbonate | 4.0 | 4.0 | 4.0 | 5.0 | 4.0 | 4.0 |
| PEG 4000 | 0.5 | 0.5 | 0.5 | — | 0.5 | 0.5 |
| Misc (water etc) | 2.0 | 2.0 | 2.0 | 2.0 | 2.0 | 2.0 |
| Dry additives | | | | | | |
| Citric acid | — | — | — | — | 2.0 | — |
| PB4 | — | 3.0 | — | — | — | — |
| PB1 | — | — | 4.0 | 1.0 | — | — |
| Percarbonate | 12.0 | — | — | 1.0 | — | 2.0 |
| Carbonate | — | 5.3 | 20.0 | 5.0 | 14.0 | 24.0 |
| NOBS | 0.5 | — | 0.4 | 0.3 | — | 0.6 |
| PAP | — | 0.9 | — | — | 0.3 | — |
| TAED | 0.6 | 0.4 | 0.6 | 0.3 | 0.9 | 0.5 |
| Methyl cellulose | 0.2 | — | — | — | — | 0.5 |
| DTPA | 0.7 | 0.5 | 1.0 | 0.5 | 0.5 | 1.2 |
| Speckle | 0.3 | 0.2 | 2.0 | — | 0.7 | 0.5 |
| SKS-6 | 8.0 | — | — | — | — | — |
| STS | — | — | 2.0 | — | 1.0 | — |
| Cumene sulfonic acid | — | 1.0 | — | — | — | 2.0 |
| Lipase | 0.2 | — | 0.2 | — | 0.2 | 0.4 |
| Cellulase | 0.2 | 0.2 | 0.2 | 0.3 | 0.2 | 0.2 |
| Amylase II | 0.2 | — | 0.1 | — | 0.2 | — |
| Protease | 0.5 | 0.5 | 0.5 | 0.3 | 0.5 | 0.5 |
| PVPVI | — | — | — | — | 0.5 | 0.1 |
| PVP | — | — | — | — | 0.5 | — |
| PVNO | — | — | 0.5 | 0.3 | — | — |
| QEA | — | — | — | — | 1.0 | — |
| SRP I, II, or III | 0.2 | 0.5 | 0.3 | — | 0.2 | — |
| Silicone antifoam | 0.2 | 0.4 | 0.2 | — | 0.1 | — |
| Mg sulfate | — | — | 0.2 | — | 0.2 | — |
| Misc/minor to 100% | | | | | | |

EXAMPLE 3

The following detergent formulations in the form of a tablet, bar or granular formulation are in accord with the invention.

| | K | L | M | N |
|---|---|---|---|---|
| Component I–XII | balance | balance | balance | balance |
| Spray on | | | | |
| C25E3 or E4 | — | — | — | 2.0 |
| C45E5 or E7 | — | — | — | 2.0 |
| Brightener/photobleach | — | — | 0.5 | 0.5 |
| Perfume | 0.2 | 0.3 | 0.3 | — |
| Dry additives | | | | |
| Carbonate | 5.0 | 10.0 | 13.0 | 5.0 |
| PVPVI/PVNO | 0.5 | — | 0.3 | — |
| Protease | 1.0 | 1.0 | 1.0 | 0.5 |
| Lipase | 0.4 | — | — | 0.4 |
| Amylase | 0.1 | — | — | 0.1 |
| Cellulase | 0.1 | — | — | 0.1 |
| DTPA | 0.5 | 0.3 | 0.5 | 1.0 |
| PB1 | 5 | 3.0 | 10 | 4.0 |
| PAP/DOBA | 1.0 | — | 0.4 | — |
| TAED | 0.5 | 0.3 | 0.5 | 0.6 |
| Sulfate | 4.0 | 5.0 | — | 5.0 |

-continued

| | K | L | M | N |
|---|---|---|---|---|
| SRP I, II or III | 0.2 | 0.4 | 1.0 | 0.5 |
| Sud supressor | — | 0.5 | — | — |
| Speckle | 1.8 | 0.8 | 0.7 | — |
| Flocculating agent | — | — | 0.1 | 0.2 |
| Perfume (starch) | — | 0.2 | 0.3 | 0.5 |
| Misc/minor to 100% | | | | |

EXAMPLE 6

The following detergent formulations in the form of a tablet, bar or granular formulation are in accord with the invention.

| | O | P | Q | R | S |
|---|---|---|---|---|---|
| Component I–XII | balance | balance | balance | balance | balance |
| Agglomerate | | | | | |
| Clay | 9.0 | — | — | | |
| Wax | 0.5 | — | — | | |
| Glycerol | 0.5 | — | — | | |
| Agglomerate | | | | | |
| LAS | 15.0 | 5.0 | 5.0 | | |
| TAS | | | 1.0 | | |
| Silicate | 3.0 | 3.0 | 4.0 | | |
| Zeolite A | 8.0 | 8.0 | 8.0 | | |
| Carbonate | 8.0 | 8.0 | 4.0 | | |
| Spray On | | | | | |
| Perfume | 0.3 | — | — | 0.3 | 0.3 |
| C45E7 or E9 | | — | — | 2.0 | 2.0 |
| C25E3 or E4 | 2.0 | — | — | | 2.0 |
| Dry additives | | | | | |
| Citrate or citric acid | 2.5 | — | 2.0 | 2.5 | 2.5 |
| Clay I or II | — | 3.0 | 3.0 | — | — |
| Flocculating agent I or II | — | — | — | — | — |
| Bicarbonate | — | 3.0 | — | — | — |
| Carbonate | 15.0 | — | — | 5.0 | 11.0 |
| TAED | 1.0 | 2.0 | 5.0 | 1.0 | — |
| Sodium perborate or percarbonate | 6.0 | 7.0 | 10.0 | 6.0 | — |
| SRP I, II or III | 0.2 | 0.1 | 0.2 | 0.5 | 0.3 |
| CMC or nonionic cellulose ether | 1.0 | 1.5 | 0.5 | — | — |
| Protease | 03 | 1.0 | 1.0 | 0.3 | 0.3 |
| Lipase | — | 0.4 | 0.4 | — | — |
| Amylase | 0.2 | 0.6 | 0.6 | 0.2 | 0.2 |
| Cellulase | 0.2 | 0.6 | 0.6 | 0.2 | 0.2 |
| Silicone antifoam | — | 5.0 | 5.0 | — | — |
| Perfume (starch) | 0.2 | 0.3 | — | — | — |
| Speckle | 0.5 | 0.5 | 0.1 | — | 1.0 |
| SKS-6 (silicate 2R) | 3.5 | — | — | — | 3.5 |
| Photobleach | 0.1 | — | — | 0.1 | 0.1 |
| Soap | 0.5 | 2.5 | — | 0.5 | 0.5 |
| Sodium sulfate | — | 3.0 | — | — | — |
| Misc/minors to 100% | 100.0 | 100.0 | 100.0 | 100.0 | 100.0 |
| Density (g/liter) | 850 | 850 | 850 | 850 | 850 |

What is claimed is:

1. A solid fabric softening component comprising (a) a clay;

(b) at least 5% of a surfactant system;

(c) at least 15% by weight of a solid carrier material comprising a member selected from the group consisting of a phosphate builder and a mixture of a zeolite A builder and a phosphate builder; and (d) a flocculating agent selected from the group consisting of alum and lime; wherein said clay, said surfactant system, said solid carrier material, and said flocculating agent are in an intimate mixture with one another.

2. A component according to claim 1 wherein the carrier material further comprises an inorganic carbonate salt which is present at a level of from 10% to 60% by weight of the component.

3. A component according to claim 2 comprising said carbonate salt and a water-swellable disintegrant or an acidic compound capable of reacting with said carbonate salt to produce effervescence, or mixtures thereof.

4. A component according to claim 1 wherein the surfactant system is present at a level of from 10% to 70% by weight and comprises at least an anionic sulphonate surfactant or an anionic sulphate surfactant.

5. A component according to claim 1 wherein the surfactant system comprises a nonionic surfactant, comprising at least one alkoxylated alcohol surfactant.

6. A composition according to claim 1 wherein the clay is present at a level of from 5% to 60% by weight, and comprises a smectite clay.

7. A component according to claim 1 comprising at least 0.1% by weight of a brightener.

8. A component according to claim 1 in a form selected from the group consisting of a spray-dried particle, agglomerate, extrudate and mixtures thereof.

9. A component according to claim 1 comprising at least 5% by weight of water.

10. A component according to claim 1 comprising a fabric care agent selected from the group consisting of soil release polymers, cellulosic polymers, dye transfer inhibitors, cationic softeners, and mixtures thereof.

11. A component according to claim 1 comprising a mixture of clays.

12. A process for making a component according to claim 1 comprising the steps of first mixing the clay and the flocculating agent to form an intimate mixture and subsequently mixing the intimate mixture with the surfactant system and the carrier material.

13. A process for making a component according to claim 1 comprising the steps of first mixing the flocculating agent, the surfactant system or part thereof and the carrier material or part thereof to form an intimate mixture and subsequently mixing the intimate mixture with the clay and optionally the remaining part of the surfactant system and the remaining part of the carrier material.

* * * * *